United States Patent [19]

Gongwer

[11] 4,173,195

[45] Nov. 6, 1979

[54] HYDRODYNAMIC CONFIGURATION FOR TOWED SUBMERSIBLE BODY

[75] Inventor: Calvin A. Gongwer, Glendora, Calif.

[73] Assignee: The Bendix Corporation, North Hollywood, Calif.

[21] Appl. No.: 864,570

[22] Filed: Dec. 27, 1977

[51] Int. Cl.[2] ..... B63B 21/56

[52] U.S. Cl. ..... 114/244; 114/330

[58] Field of Search ..... 244/199, 200; 114/242, 114/244, 245, 312, 330; 9/8 R

[56] References Cited

U.S. PATENT DOCUMENTS

| | | | |
|---|---|---|---|
| 3,144,848 | 10/1964 | Knott | 114/242 |
| 3,450,082 | 6/1969 | Demarest | 114/312 |
| 3,509,848 | 5/1970 | Salmon | 114/245 |

OTHER PUBLICATIONS

Intro. to Fluid Dynamics-Batchelor-1967-pp. (Plates) 10, 11, FIG. 5.11.7.

*Primary Examiner*—Trygve M. Blix

*Assistant Examiner*—D. W. Keen

*Attorney, Agent, or Firm*—Robert C. Smith; William F. Thornton

[57] ABSTRACT

A towed submersible body is utilized for housing underwater instrumentation, particularly a scanning type of sonar, the housing constituting a sphere which is attached at its top to a cable towed by a helicopter or by a surface vessel. The spherical housing of acoustically transparent material has hatches and ports top and bottom to aid in flooding and draining the interior. Ballast weights are fastened to the bottom of the housing near the lower hatch to control the location of the wet center of gravity of the body such that it is significantly below and slightly forward of the geometrical center of the sphere to provide stability during towing. A small projection on the housing in the form of a small diameter wire rope fastened to a meridian passing through the tow point or a point approximately 10° aft of the tow point provides for stable towing at speeds up to approximately eight knots with the tow cable at an angle not more than about 10° from the vertical.

9 Claims, 3 Drawing Figures

FIG. 1
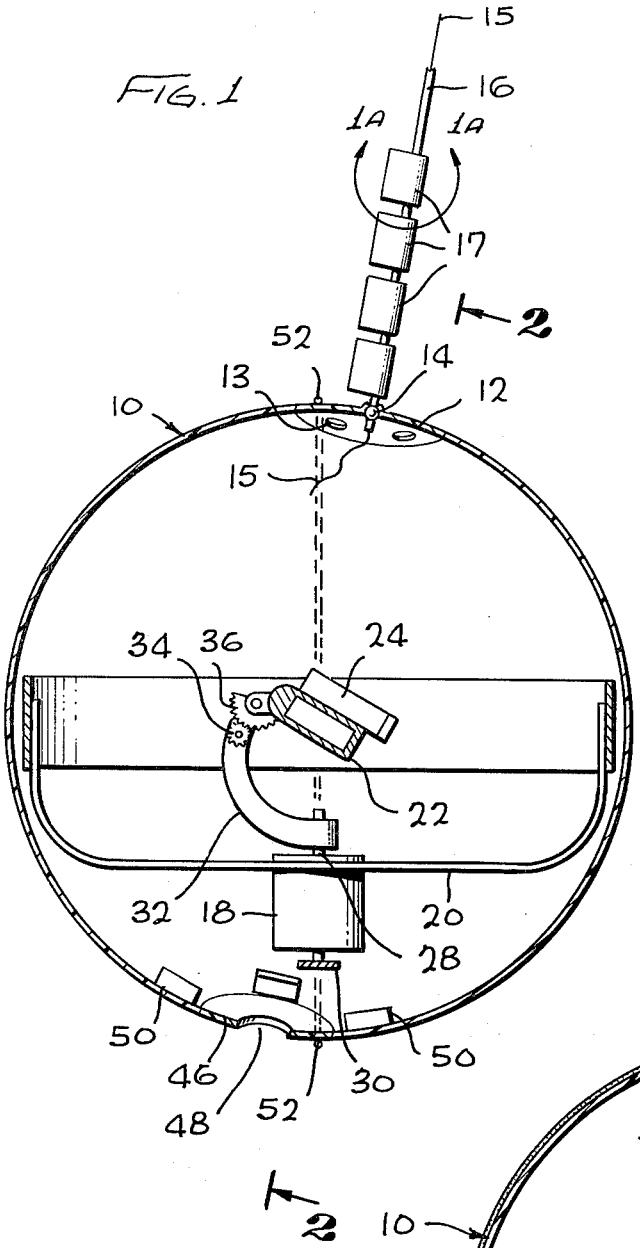
FIG. 1A
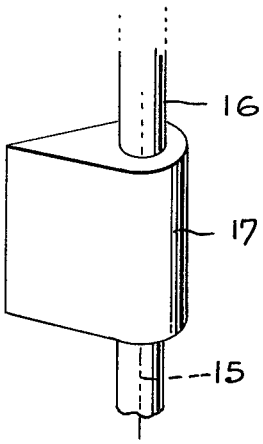
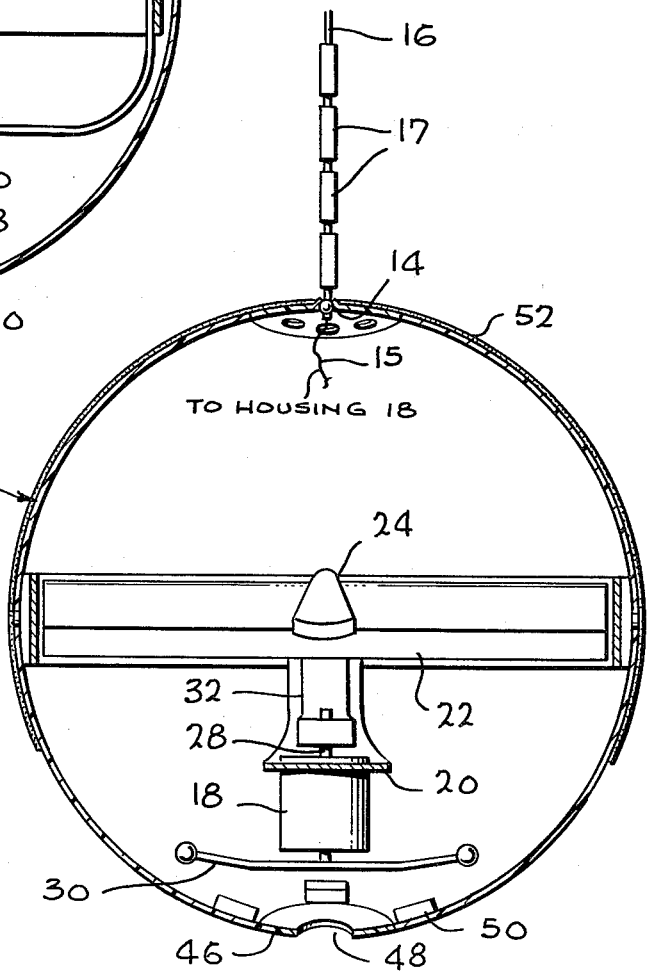
FIG. 2

HYDRODYNAMIC CONFIGURATION FOR TOWED SUBMERSIBLE BODY

The invention herein described was made in the course of or under a contract with the Navy Department.

BACKGROUND OF THE INVENTION

Towed submersible transducers for sonar have usually been of a configuration largely defined by the function of the sonar equipment itself with hydrodynamic consideration secondary. Another configuration which has been used involves a somewhat streamlined projectlie shape with a center of gravity near one end and a large diameter shroud carrying receiving hydrophones attached through a swivel arrangement at the other end to act as a stabilizing tail. Recently there has been a requirement for a 360° scanning sonar which is to be towed from a helicopter or from a vessel. Conventional hydrodynamics indicated that a good approach would be to make a somewhat streamlined vehicle with control surfaces supporting an exposed rotatable transducer. This was considered not satisfactory because the transducer and extended parts of the towed body were vulnerable to rough handling on decks of ships and from helicopters, etc. Another approach was to build a sonar into a somewhat streamlined housing but to retain the fins or control surfaces. This approach, although certainly operative, is subject to some of the same dangers of exposure to damage from rough handling and is also somewhat unsatisfactory because of the limited volume which is normally accommodated within such a housing. Alternatively, if the housing is made larger, then the control surfaces extend outwardly such that the overall dimensions make the transducer awkward to handle. There is, therefore, a need for a towed submersible body configuration capable of housing a scanning sonar system or other underwater instrumentation with sufficient volume to permit some freedom of movement within the body, which is rugged and provides reasonably good protection for the contents and which may be towed at some significant speed without such instability as would adversely affect operation of the sonar or other instrumentation.

DESCRIPTION OF THE DRAWINGS

FIG. 1 is a side view, mostly in section, of my submersible body at its normal attitude while being towed;

FIG. 1A is an enlarged view of a portion of FIG. 1 giving details of the tow cable and fairing members.

FIG. 2 is a sectional view of the submersible body of FIG. 1 taken along line 2—2 of FIG. 1.

DESCRIPTION OF THE PREFERRED EMBODIMENT

A towed submersible body is shown in FIG. 1 in association with a scanning type of sonar which is mounted in its interior. A spherical housing 10, typically formed of two separable hemispheres of acoustically transparent material such as various types of plastic or rubber, is approximately 42 inches in diameter, this dimension being established by the dimensions and clearances necessary for the enclosed equipment. Hatches of approximately 10 inches diameter are located at the top and bottom of the housing to permit entry and egress of air and water, since the housing is a free-flooded design. The upper hatch 12 includes a number of ports 13 for this purpose and also supports, typically, a ball and socket cable attachment 14 which receives and securely holds a ball on the end of the strength member portion of the tow cable 16. Electrical power and signal carrying wires 15 are extended from the cable 16 through an O-ring seal in the attachment 14 and from thence to a housing 18 of the sonar system. To reduce the drag of the cable as it is towed, a plurality of firing members 17 are attached thereto such that they swivel on the cable in weather vane fashion (see FIG. 1A). It is desired that the 42-inch sphere be stable for towing speeds from approximately 2 knots to 8 knots. For other diameters the "Froude" scaling causes speed to vary as the square root of the diameter to maintain dynamic similarity.

Attached to the housing 18 is a bracket 20 forming part of a gimbal structure supporting the receiving hydrophone array 22 and sonar projector 24. Housing 18 contains an electric motor which turns a shaft 28 to rotate a bracket 32 to cause the sonar array to scan in a 360° arc. The motor also turns a counter rotation balancer 30 which creates an oppositely directed moment within the housing to minimize turning effects on the housing 10 when scanning is taking place.

Bracket 32 carries at its upper end a drive gear 34 meshing with a gear sector 36 which is attached to the hydrophone array 22 and the projector 24 to direct the sonar beam up or down as desired. Drive gear 34 may be driven by any convenient means such as by a separate motor attached to bracket 32.

Near the bottom of housing 10 is a hatch 46 having a large opening 48 to assist in flooding and draining housing 10. Positioned near this hatch are a plurality of ballast members 50 which are sized and positioned to place the wet center of gravity of the body substantially below its geometrical center and slightly forward thereof. For a 42-inch spherical housing having a net weight of about 675 pounds, it proved satisfactory to place the wet center of gravity about 7.5 inches below the geometrical center of the sphere. A greater amount would also be satisfactory, this dimension not being critical so long as the wet center of gravity is significantly below the geometric center. A somewhat greater degree of criticality was found to exist with respect to the distance the wet center of gravity was placed ahead of the geometric center. With the weights and dimensions discussed above, the body was found to tow with the most stability when the wet center of gravity was placed 0.17 inch forward of the vertical center line. Moving the wet center of gravity to two inches forward of the vertical center line made the body less stable. These dimensions are subject to variation depending upon the dimensions and weight of the particular body selected, but the wet center of gravity should preferably be significantly below the geometric center of the body and slightly forward of the vertical center line.

Towing the bare spherical body thus far described resulted in instability for towing speeds above about 2½ knots and with cable lengths over about 50 feet. To assure proper operation of the associated sonar system, it was determined that pitch and roll cannot exceed 10° under all operating conditions. For helicopter deployment, the maximum acceptable trail distance behind the helicopter was determined to be 125 feet for an altitude of 100 feet and the sphere at a depth of 150 feet. Any greater trail distance would result in excessive canting of the sphere. Since the cable itself was found to contribute excessive drag which would tend to increase the trail distance, the fairing members 17 were employed to provide a substantial reduction in cable drag.

Two solutions were found to the problem of improving stability of the spherical body, one of which is to form a projection which goes around the circumference of the spherical body at a meridian which passes through the tow point or around a great circle canted about 10° aft of the tow point and preferably located to be essentially perpendicular to the direction of tow. The other is to use baffles inside the spherical housing to provide damping. While the baffle arrangement was somewhat successful, it was less stable at higher towing speeds (8 knots), and the baffles interfered with the placement and operation of the sonar equipment. The projection used was in the form of a small diameter wire cable 52 fastened around the sphere at one of the described locations. For applicant's 42-inch sphere, the optimum size of cable 52 was experimentally determined to be one-eighth inch diameter, but this is not a sharply varying factor, and some variation from this size will also provide acceptable operation.

It is known that when one tows a sphere it tends to become unstable and oscillate because the flow over the sphere is attached to the surface to a point just beyond its maximum diameter and then tends to become detached and to break away with eddy currents and vortices. This breakdown is not evenly distributed around the sphere, however, such that on one side the vortices are occurring, thus causing a reduced pressure area on that side while the attached flow continues on the other side and actually responds to the lowered pressure by wrapping further around the sphere. This then causes the sphere to move in the direction of the lowered pressure area, thereby slowing the flow in the region which tends to restore the attached flow and increase the pressure against the sphere on that side. At the next instant the increased velocity on the opposite side results in a breakdown of its attached flow pattern into vortices and turbulence with a reduced pressure on that side, tending to move the sphere in a different direction. In this manner the sphere will be caused to oscillate as it is being towed. The wire projection apparently causes a uniform interruption of the attached flow pattern all around the sphere, resulting in uniformly distributed flow detachment and turbulence to the rear of the wire projection without the unbalanced factors described above which cause oscillation of the sphere. The magnitude of this turbulence is also somewhat limited, which limits the drag coefficient of the sphere. The wire also provides damping to limit such oscillations as are produced.

While the above description discusses a towed submerged body in terms of an application for a scanning type of sonar, the teachings herein may obviously be useful for a towed submerged body containing other types of sonar, instrument packages, etc. It will be recognized that the specific weights and dimensions relative to the wet center of gravity of the described sphere will not be the same for spheres of different diameters and weights. The general principles will apply in most cases, however, such that the wet center of gravity should be significantly below the geometric center of the sphere and slightly forward thereof. The projection need not be of wire, but wire rope was most conveniently employed. In production of substantial numbers of such towed bodies, the projection would preferably be molded into the housing. Since the texture of the wire rope seemed to perform better than a smooth projection, it is believed that such texture should preferably be incorporated into the mold. The diameter of the wire chosen (⅛ inch) adds only about 0.3% of the diameter of the sphere, and this would be a good approximation for spheres of different diameter, but the ratio may vary somewhat for other applications, and an optimum may need to be experimentally determined. And while the above discussion covers towing from a helicopter, the same housing structure may also conveniently be towed from a ship or boat.

I claim:

1. A submersible body to be towed in the water from a suspending line comprising a hollow spherical housing having top and bottom ports to facilitate flooding of said housing, means attached to the top of said housing and fastened to said line for suspending said body, ballast means in said housing near the bottom thereof for locating the wet center of gravity of said body significantly below its geometric center and a narrow projection extending around a great circle of said housing from approximately top to bottom and generally normal to the direction of tow to interrupt the flow around said body substantially uniformly around its periphery and to provide damping in yaw and pitch.

2. A towed submersible body as set forth in claim 1 wherein said ballast means are positioned to locate the wet center of gravity of said body slightly forward of its geometrical center with respect to the direction of tow.

3. A towed submersible body as set forth in claim 1 wherein said projection extends around the circumference of said housing through said means for suspending said housing.

4. A towed submersible body as set forth in claim 1 wherein said projection consists of a wire extending around the circumference of said housing through said means for suspending said housing.

5. A towed submersible body as set forth in claim 1 wherein said projection extends around the circumference of said housing through a point approximately 10° aft of said means for suspending said housing.

6. A towed submersible body as set forth in claim 1 wherein said projection consists of a wire extending around the circumference of said housing through a point approximately 10° aft of said means for suspending said housing.

7. A towed submersible body as set forth in claim 1 wherein said line comprises a faired cable to reduce drag of said cable.

8. A towed submersible body as set forth in claim 1 wherein said housing includes top and bottom hatches, said ports are located in said hatches and said means for suspending said body is attached to said top hatch.

9. For use with a sonar system in which a sonar transducer assembly is lowered into, raised from and towed in the water, a housing for said transducer comprising a hollow spherical member having top and bottom hatches, top and bottom ports to facilitate flooding of said housing, means attached to said top hatch for suspending said housing, ballast means in said housing near the bottom thereof for locating the wet center of gravity of said sonar assembly significantly below its geometric center and slightly forward thereof with respect to the direction of tow, a narrow projection extending around the circumference of said housing from top to bottom and normal to the direction of tow to interrupt the flow around said body substantially uniformly around its periphery.

* * * * *